United States Patent [19]

Stephanos

[11] 4,120,403

[45] Oct. 17, 1978

[54] PHOTOELECTRIC APPARATUS FOR SORTING VARIEGATED ARTICLES ACCORDING TO SIZE

[75] Inventor: Stephen P. Stephanos, Oakland, Calif.

[73] Assignee: George E. Lauer, Oakland, Calif.

[21] Appl. No.: 700,547

[22] Filed: Jun. 28, 1976

[51] Int. Cl.[2] ..... B07C 1/10

[52] U.S. Cl. ..... 209/564; 209/586; 250/560; 356/156

[58] Field of Search ..... 209/82, 111.7 T, 111.7 R; 250/560; 356/156, 167

[56] References Cited

U.S. PATENT DOCUMENTS

| | | | |
|---|---|---|---|
| 3,513,321 | 5/1970 | Sherman | 209/111.7 T X |
| 3,525,433 | 8/1970 | Babb | 209/111.7 T X |
| 3,774,040 | 11/1973 | Stephanos | 250/560 |

*Primary Examiner*—Robert B. Reeves

*Assistant Examiner*—Joseph J. Rolla

*Attorney, Agent, or Firm*—Harris Zimmerman

[57] ABSTRACT

A photoelectric apparatus for sorting articles according to size includes a vertical column of photoelectric pickups disposed adjacent to the conveyor on which the articles pass by. The apparatus includes a clock pulse generator synchronized with the conveyor, the clock pulses driving a plurality of sizing logic circuits. The signals from the photoelectric pickups are fed through a multiplexer to each sizing circuit, which counts the clock pulses while the appropriate pickups are being interrupted by an article passing by. If a given sizing circuit counts to within a predetermined number of pulses while the article passes the column, it locks out the other sizing circuits and actuates a time delay relay. The relay actuates a solenoid downstream of the column to knock the article off the conveyor and into an appropriate collection device.

11 Claims, 4 Drawing Figures

PULSE AMPLIFIER & DIVIDER
18
CLOCK PULSE GENERATOR
17
14
11
LENGTH DIVIDERS & LOGIC
26
27
LENGTH DIVIDERS & LOGIC
26
27
PHOTOCELL AMPLIFIER
22
PHOTOCELLS
21
LIGHT SOURCE
19
FRUIT
16
WIDTH GO & NO-GO LOGIC
WIDTH GO & NO-GO LOGIC
28
MULTIPLEXER
32
DELAY COUNTERS
DELAY COUNTERS
29
SOLENOID ACTUATOR & DWELL TIMER
SOLENOID ACTUATOR & DWELL TIMER
31
SOLENOID
33
13
12
16

PHOTOELECTRIC APPARATUS FOR SORTING VARIEGATED ARTICLES ACCORDING TO SIZE

BACKGROUND OF THE INVENTION

It is well known in the field of sorting and packaging fruits, vegetables, tubers, and the like to employ photoelectric devices to accomplish the task of sorting the articles into like size groupings. One such device for accomplishing the sorting is disclosed in U.S. Pat. No. 3,774,040, issued on Nov. 20, 1973 to Stephen P. Stephanos.

These devices generally include a plurality of sorting heads, each head being provided with at least one horizontal and one vertical photoelectric sensor. Each sorting head requires its own associated circuitry, and the multiplicity of sorting heads and circuits is a major cost factor. Also, setting up and maintaining such a system of individual units is difficult.

Further, the vertically disposed photoelectric sensor includes at least one element, whether light source or sensor, which is disposed subjacent to the article conveyor. This subjacent element tends to accumulate dirt and debris, especially from freshly washed fruit, which interferes with the light beam and disrupts and accurate measuring and sorting of the articles. Some operators have resorted to using compressed air to blow away the dirt and debris, but this technique represents a substantial additional cost.

The horizontally disposed photoelectric sensors are used to determine the width (height) of the articles. Each of the multitude of sorting heads must be adjusted so that the horizontal sensor is disposed at the correct height above the conveyor, so that articles may be correctly sorted as to width as well as length. This manner of adjustment is arduous, and difficult to alter when the size categories must be changed.

Also, the multiple sorting head approach is utilized most effectively when the heads are set up to select articles of successively increasing or decreasing length. Due to the fact that the width selection is usually a binary choice, and due to selection errors caused by the articles being spaced too close together, many lots of articles must be sent through the sorting apparatus more than once to properly sort the articles into all the correct categories. This is an extravagance that is rarely affordable.

SUMMARY OF THE INVENTION

The present invention generally comprises an article sorting device in which only one sensing station is required to measure each of a passing stream of articles and to direct the articles into the proper one of a plurality of size groupings. The sensing station includes a plurality of photoelectric sensors disposed in a vertical array which is situated opposite a column light source. The articles pass therebetween on a high speed conveyor and are measured by the height of time which any of the sensors are interrupted.

The signals from the photoelectric sensors are amplified individually and fed to a plurality of sizing logic circuits. Each sizing circuit includes a length counter which counts clock pulses during the interval in which any of the sensors are interrupted, and sets a flip flop if the count falls within a preset range. The sizing circuit also includes a range comparator which is actuated by the length comparator, and which also counts pulses within a given range and sets a flip flop if the count is within the preset range.

Each sizing circuit includes a width counter which is connected through a multiplexer to all of the photocells. The width counter senses the highest sensor interrupted by the passing object, and compares its number in the vertical column with a preset number. If the comparison is favorable the width counter sets another flip flop.

All of the flip flop outputs are connected to a NOR gate. The NOR gate actuates an output gate which controls a solenoid disposed to remove the object from the conveyor and direct it into the proper size group collecting device. The solenoid is driven by a time delay pulse counter which permits the sensed object to be conveyed down the line to the solenoid. The output gate also sends a signal through a feedback line to the other sizing circuits to lock them out and prevent the other circuits from selecting the same object.

THE DRAWING

DESCRIPTION OF THE PREFERRED EMBODIMENT

Figure 1:
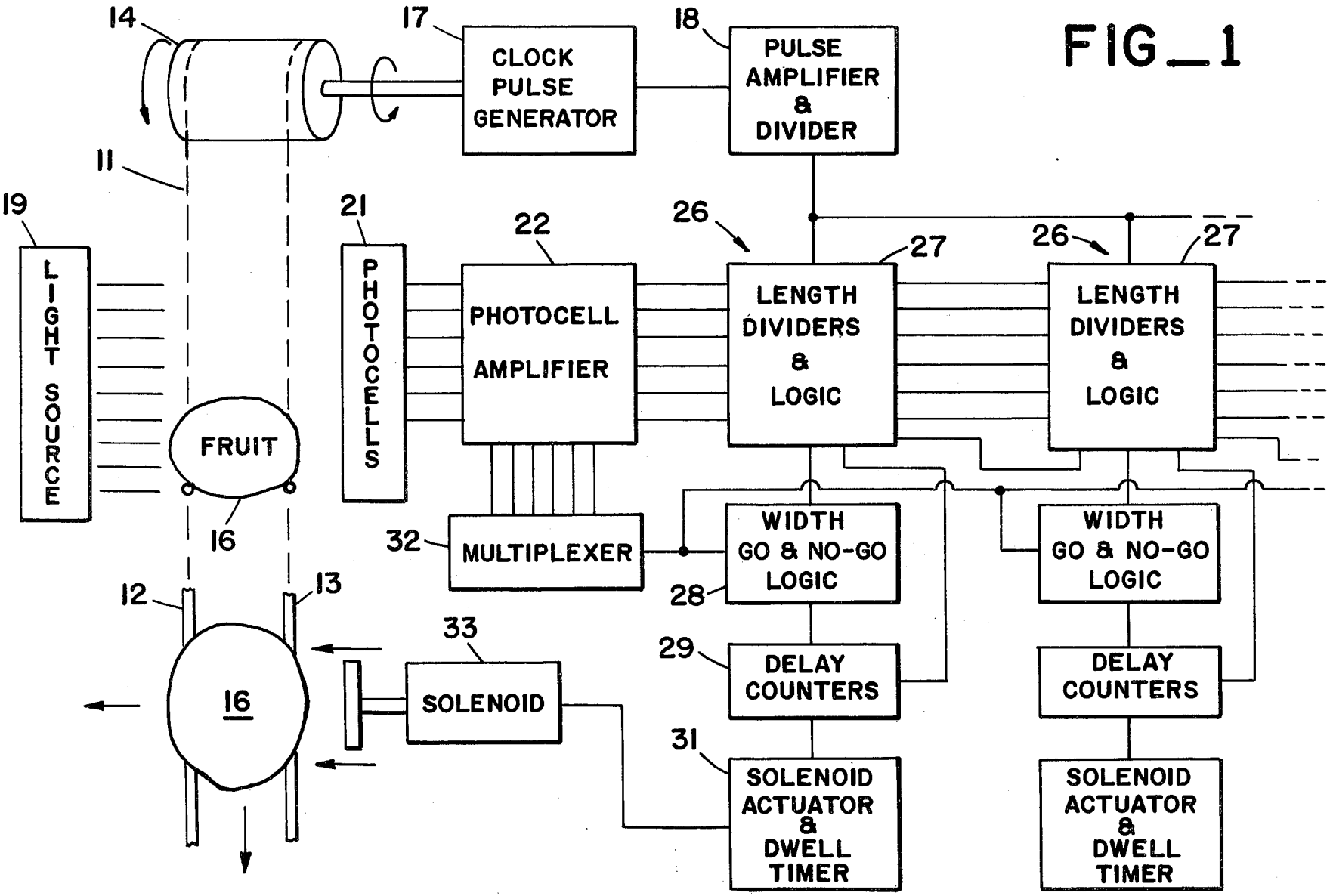
FIG. 1 is a schematic representation of the sorting apparatus of the present invention.
Figure 2:
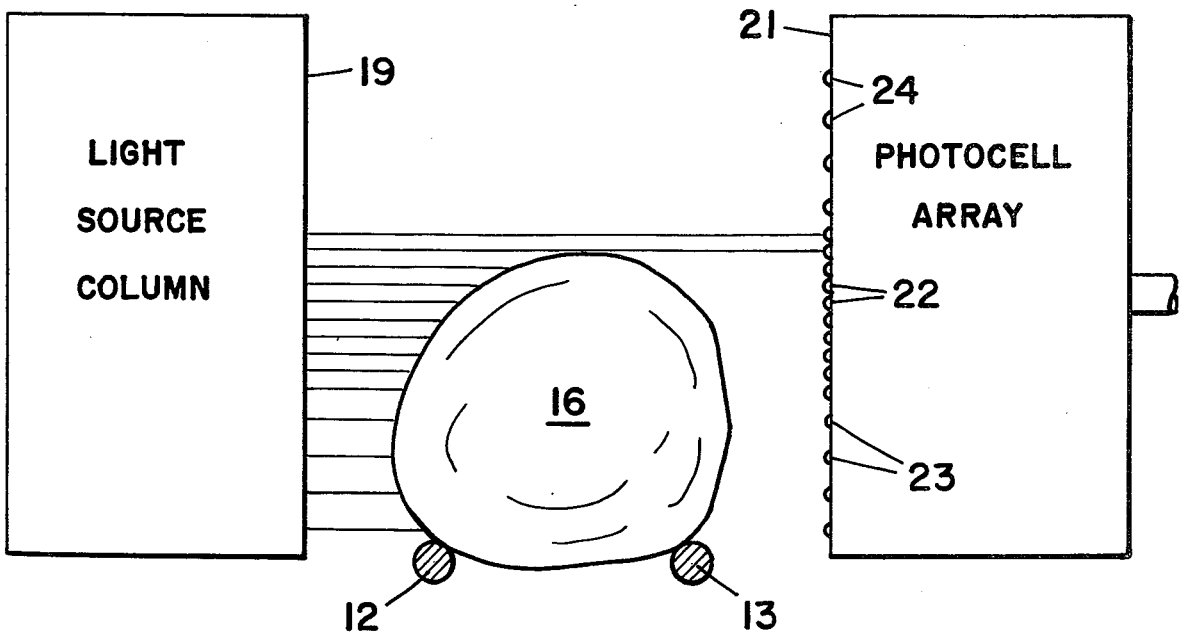
FIG. 2 is a vertical elevation of the photocell arrangement of the sorting apparatus of the present invention.

The present invention generally comprises an apparatus for sorting articles or objects according to size. As shown in FIG. 1, the objects, such as fruit, tubers, or vegetables 16 are supported on a translating conveyor. The conveyor includes a pair of flexible endless tubes or hoses 12 and 13 which support the objects, and which are driven by a rotary motor mechanism 14. The conveyor and drive mechanism are well known in the art, and are not considered to be part of the present invention.

The motor mechanism is connected to a clock pulse generator 17 which produces voltage spikes in response to a uniform incremental advance of the conveyor motor mechanism. Such a pulse generator is disclosed in the Stephanos patent cited in the foregoing. The output of the clock pulse generator is fed to a pulse amplifier and divider 18 which amplifies the pulses and divides them by a constant integer to generate a stream of pulses which drive the logic elements of the apparatus.

Disposed adjacent to the conveyor is a light source column 19 extending generally vertically, and a photocell array 21 opposed and parallel to the light source column. The photocell array includes twenty photocells directed at the light source column. The lower photocells 23 are spaced at $\frac{1}{4}$ inch (0.64 cm) intervals toa be interrupted by the smallest object passing through the light beam from the column 19. The photocells 22 are spaced at intervals of 1/10 inch (0.25 cm) to be interrupted in the range of object heights most frequently encountered and most in need of exact measurement. The upper photocells 24 are also spaced at 0.64 cm intervals to measure the rare object which extends above the photocells 22.

the output of each photocell is amplified by the photo cell amplifier 22, and thence fed to each of a plurality of sizing logic circuits 26. Each logic circuit 26 includes a length divider and logic section which is connected both to the photocell amplifier output and to the pulse amplifier and divider 18. The length divider 27 senses the occurrence of any of the photocells being interrupted, and counts pulses during such occurrence. If the pulse count exceeds a preset minimum and falls within a preset range, the length divider 27 actuates a delay counter 29.

The photocell amplifier 22 is also connected to a multiplexer which in turn is connected to a width go and no-go counter 28. The counter 28 counts the highest photocell which is interrupted by the passing object, and compares it with a preset minimum and range. It should be noted that height in one dimension is equal to width in another dimension, and thus the terms may be used interchangeably. If the count comparison is favorable, the counter 28 also actuates the delay counter 29. The delay counter 29 is connected to the pulse amplifier and divider, and upon actuation by both the length dividers and width counter it counts a preset number of pulses. In this manner the object is permitted to travel down the conveyor from the photocell array 21 to the solenoid 33.

The delay counter is connected to the solenoid actuator and dwell timer 31, which controls the large current required to drive the solenoid. The dwell portion controls the length of time during which the solenoid is extended. In this manner the momentum imparted to the object may be controlled to provide sufficient impulse to knock the object off of the conveyor as it passes the solenoid without damaging the object.

It should be noted that the apparatus of the present invention may include a plurality of solenoids disposed adjacent to the conveyor, each solenoid controlled by a separate sizing logic circuit 26. Thus the one sensing station comprising the photocell array 21 may control a plurality of sizing logic circuits to sort the objects into many finely divided size categories.

Figure 3:
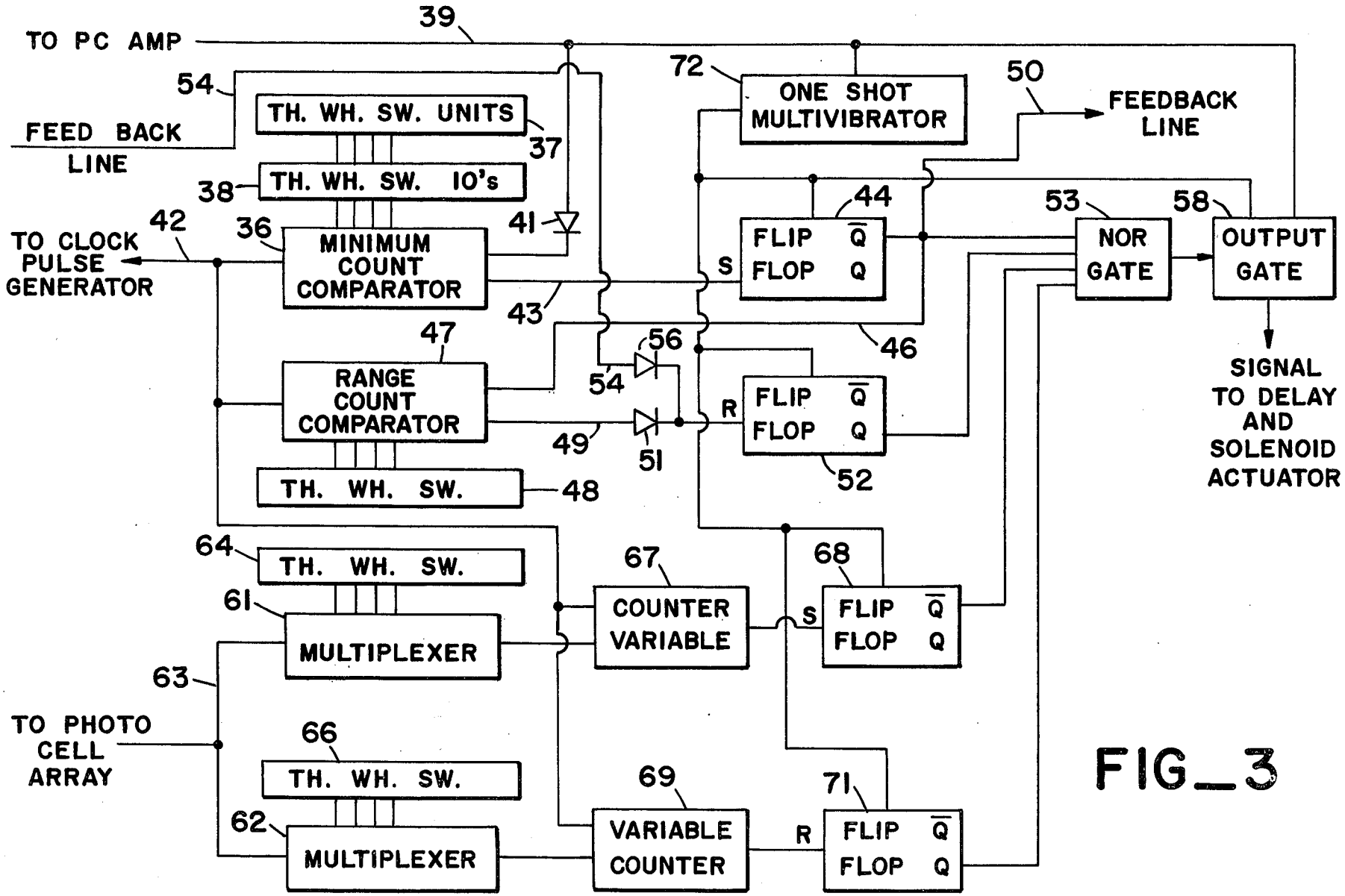
FIG. 3 is a schematic representation of the length and width counting portion of each sizing circuit of the present invention.

The width go and no-go counter 28 and the length divider and logic 27 are shown in greater detail in the schematic diagram of FIG. 3. The length divider includes a minimum count comparator 36 and its associated thumb wheel switches 37 and 38 representing units and tens respectively. The switches 37 and 38 produce BCD signals which are fed into the comparator 36 for comparison with a cumulative count of clock pulses performed by the device 36. The count comparator 36 is connected to the clock pulse generator through line 42. A conductor 39 connected to the trigger of the counter 36 through isolating diode 41 carries an OR sum of all of the photocell signals. Thus any interruption of any of the photocell sensors will trigger the counter 36 to begin to count clock pulses.

The output of the counter 36 is connected by line 43 to the set input of flip flop 44. The Q output of the FF 44 is connected to an input of NOR gate 53, through line 46 to the trigger of a range count comparator 47, a thumb wheel switch 48 connected to the counter 47 provides a BCD signal to the counter for comparison with a cumulative count of pulses from the clock pulse generator which is performed by the device 47. The output of the range count comparator 47 is fed through line 49 and isolating diode 51 to the RESET input of flip flop 52. The Q output of the FF 52 is connected to the NOR gate 53. Also connected to the RESET input of the FF 52 is a feedback line 54 from another sizing logic circuit which is adjusted to select larger objects. The feedback line is connected through isolating diode 56 to the FF 52, in an OR configuration with the line 49.

The NOR gate 53 has its output connected to an output gate 58 which in turn controls the actuation of the solenoid 33. The NOR gate requires that all inputs thereto be zeros before it can generate a high output signal. The Q output of FF 44, which is normally binary one in the reset condition, is changed to zero by the count comparator 36 triggering the SET input of the FF 44. The Q output of FF 52, which is normally zero, can be changed to a one by the range count comparator 47 triggering the RESET of FF 52. Thus, in order for the NOR gate to be enabled, the minimum counter must count out, and the range counter must not complete its count. That is, the pulse must fall within the minimum number set on the thumbwheel switches 37 and 38, and the maximum set on the thumb wheel switches 48.

It should be noted that all of the counters and count comparators mentioned in the preceding description and in the following are automatic reset devices which reset to zero as soon as the triggering signal is removed.

Also connected to the Q output of the FF 44 is a feedback line 50. The feedback line 50 is connected to the range count comparator flip flop of the sizing logic circuit which is adjusted to select the next smaller size of objects. Thus as the minimum count of the circuit of FIG. 3 is reached, the FF 44 sends a signal to the next sizing logic circuit which disables its NOR gate and prevents its selection of the same object, which is already determined to be too large for that next sizing logic circuit. Thus the same object cannot be selected by more than one sizing logic circuit. This is the function performed by the feedback line 54, which resets the FF 52 when the next larger sizing logic circuit reaches its minimum count and thus provides a binary one to the NOR gate.

The width logic 28 of the sizing logic circuit includes a pair of multiplexer circuits 61 and 62, each connected to BCD thumbwheel switches 64 and 66, respectively. Each multiplexer comprises a standard 74150 integrated circuit package, which selects any one of sixteen input channels and gates it to the output, according to the BCD control signal of the respective thumbwheel switches. The input channels from the photocell array are provided by the cable 63 to the multiplexers. It should be noted that in order to feed the twenty photocell signals into the sixteen channel multiplexer, the lower four photocells have their signals added into one channel.

The photocell that has its signal selected by the multiplexer is disposed at a known height above the conveyor 11, and this height represents the width of the object. Thus, should the object interrupt a selected photocell, it is at least as wide as the photocell is high on the vertical photocell array. However, protrusions, bumps, and the like on the object may briefly interrupt the photocell beam and produce a false indication of the true width of the bulk of the object. To prevent this occurrence, each multiplexer output is fed into a variable counter 67 or 69, respectively, which are also connected to the clock pulse generator.

Interruption of the photocell signal fed through multiplexer 61 to counter 67 causes that counter to begin counting pulses up to a preset, variable number. When that number is reached, the counter generates an output signal which acutates the SET input of FF 68. The Q output of the FF 68 is connected to the input of the NOR gate 53, so that as the counter reaches its count, the FF 68 sends a zero signal to the NOR gate. The multiplexer 61 is set to select the minimum width object, and the counter 67 assures that a sufficient length of the object has the required width.

The multiplexer 62 is set by the switch 66 to select the largest acceptable width object, and the counter 69 has its output connected to the RESET input of the FF 71. The Q output of the FF 71 is connected to the NOR gate 53, so that a zero signal is normally presented to the NOR gate. Should the counter 69 reach its preset count, indicating that a given length of the object is greater in width than the acceptable maximum, the counter will reset the FF 71 and cause a binary one to be sent to the NOR gate, blocking selection of the object.

It should be noted that in the interval when the minimum length and width counts have been satisfied, and before the maximum length and width counts have been reached, all of the inputs to the NOR gate are zero and the high output thereof would correspond to selection of the object currently passing through the photocell array. However, the output of the NOR gate is fed into the AND output gate 58 which also has inputs connected to the line 39 from the photocell amplifiers, and to the output of a one shot multivibrator 72. The output of the one shot 72 is also connected to the RESET inputs of all of the flip flops 44, 52, 68, and 71. The input of the one shot is the line 39 from the photocells, which triggers the one shot when the photocell interruption signal ceases; i.e., the signal on line 39 goes from zero to one. Thus as a given object passes out of the photocell plane, the one shot is triggered to clear all of the flip flops for the next object, and to trip the AND gate. The automatically resetting counters are self-clearing.

The one shot signal provides a brief (at 1 millisec.) interval in which the NOR gate output signal may pass through the AND gate to actuate the solenoid. Thus the object must pass through the photocells and trip the one shot before the maximum length and width counters count out, in order for the object to be selected.

Figure 4:
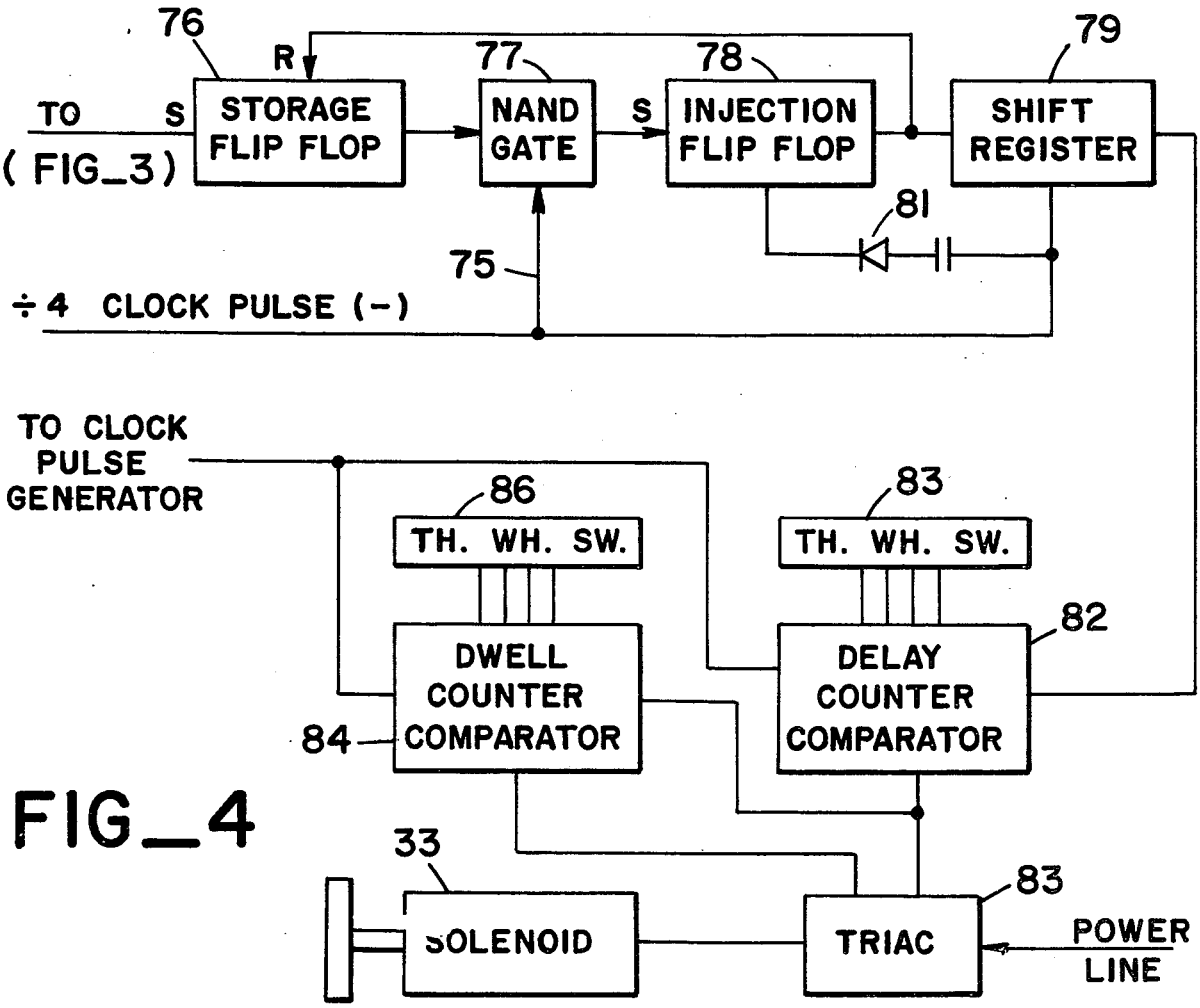
FIG. 4 is a schematic representation of the delay counters and solenoid dwell counters of each sizing circuit of the sorting apparatus of the present invention.

The output signal from output gate 58 is fed into the SET input of storage FF 76, as shown in FIG. 4. The Q output of the FF 76 is conducted into one input of a NAND gate 77. The other input of the NAND gate is from a clock line 75, which carries a pulse train corresponding to one negative pulse for each four positive pulses of the clock generator 17. Thus the actuation signal from the output gate 58 is stored in the flip flop 76 until it can pass through the NAND gate 77 in synchronism with the negative clock pulse.

The output of the NAND gate 77 is fed into the SET input of an injection flip flop 78, which is a clock driven flip flop connected to the clock line 75 through a time delay series network 81. The output of the flip flop 78 is connected to the input of serial shift register 79 and to the RESET input of the flip flop 76. Thus the signal from the NAND gate 77 will pass through the flip flop 78 during the next clock pulse, and will both reset the flip flop 76 and set the shift register 79. The signal is incremented through the shift register by the clock line 75, until it reaches the output and is sent to the trigger input of delay counter comparator 82.

The counter comparator 82 is also connected to the clock pulse generator 17 and to BCD thumbwheel switch 83. The device 82, once triggered, counts up to the binary number presented to it by the switch 83, generates an output pulse and resets itself to zero. The output pulse is fed to a triac 83 which is thus triggered to apply power line voltage to the solenoid 33. The output of the counter comparator 82 is also conducted to the trigger of dwell count comparator 84. The device 84 works in the same manner as the device 82, except that the output of the count comparator 84 is connected to the cutoff trigger of the triac.

It may be appreciated that the delay counter comparator 82 is set by the switch 83 to count a sufficient number of pulses to permit the object selected by the sizing logic circuit 26 to pass down the conveyor until it is directly adjacent to the solenoid. Since each clock pulse corresponds to a definite increment of conveyor travel, this pulse count may be determined very accurately and, once set, will never need adjustment. The dwell counter comparator controls the time during which the solenoid is extended, and thus determines the impulse applied to the object. The thumb wheel switch 86 permits adjustment of the inpulse to a fine degree, so that the selected objects are knocked off the conveyor without damage.

I claim:

1. Apparatus for sorting objects according to size, comprising a plurality of photosensors arrayed in a column, a light source column disposed parallel to and opposite said photosensor column, conveyor means for transporting said objects between said columns, clock pulse generator means for generating pulses corresponding to a uniform incremental advance of said conveyor means, a plurality of sizing logic circuit means each receiving said clock pulses and the signals from said photosensors and for selecting those of said objects which fall within predetermined length and width criteria, a plurality of impulse devices for removing said selected objects off said conveyor means, said sizing logic circuit means including a plurality of sizing logic circuits, each of said circuits connected with one of said impulse devices, each sizing logic circuit including width counter means, said width counter means including means for selecting the signal of one of said photosensors and determining if said photosensor is interrupted by a passing object, a first multiplexer for selecting and passing the signal of one of said photosensors, and a minimum width counter actuated by said one photosensor signal passing through said first multiplexer and connected to said clock pulse generator means for counting said pulses while said one photosensor is interrupted.

2. The apparatus of claim 1, wherein said minimum width counter generates an output signal upon counting to a preset minimum count.

3. The apparatus of claim 2, wherein said minimum width counter output signal is connected to a trigger of a width range counter.

4. The apparatus of claim 3, further including a second multiplexer connected to said width range counter.

5. The apparatus of claim 3, wherein the output of said minimum width counter is connected to the input of a first flip flop, and the output of said width range counter is connected to the input of a second flip flop.

6. The apparatus of claim 5, further including output gate means for controlling said impulse device, said output gate means being connected to an enabling output of said first flip flop and to a disabling output of said second flip flop.

7. The apparatus of claim 6, including a one shot multivibrator connected to said output gate means for triggering said output gate means.

8. The apparatus of claim 7, wherein said one shot multivibrator is triggered by any of said signals from said photosensors.

9. Apparatus for sorting objects according to size, comprising a plurality of photosensors arrayed in a column, a light source column disposed parallel to and opposite said photosensor column, conveyor means for transporting said objects between said columns, clock pulse generator means for generating pulse corresponding to a uniform incremental advance of said conveyor means, a plurality of sizing logic circuit means each receiving said clock pulses and the signals from said photosensors and for selecting those of said objects which fall within predetermined length and width criteria, and a plurality of impulse devices for removing said selected objects off said conveyor means; said sizing logic circuit means including a plurality of sizing logic circuits, each of said circuits connected with one of said impulse devices; said sizing logic circuit including length counter means actuated by said photosensor signals for counting said pulses during any time period when any of said photosensors are interrupted by the passage of an object thereby, said length counter means including a minimum length counter and a length range counter; wherein said minimum length counter counts to a preset count and generates an output signal which actuates said length range counter; output gate means for controlling each impulse device, said output gate means having multiple inputs, said minimum length counter output being connected through a flip flop to one of said multiple inputs, said output signal from said minimum length counter enabling said output gate means, and wherein the output signal of said range counter is connected through another flip flop to one of said inputs of said output gate means, said range length counter output signal disabling said output gate means.

10. Apparatus for sorting objects according to size, comprising a plurality of photosensors arrayed in a column, a light source column disposed parallel to and opposite said photosensor column, conveyor means for transporting said objects between said columns, clock pulse generator means for generating pulses corresponding to a uniform incremental advance of said conveyor means, a plurality of sizing logic circuit means each receiving said clock pulses and the signals from said photosensors, each of said sizing logic circuit means selecting those of said objects which fall within predetermined range and width range criteria, a plurality of impulse devices for removing said selected objects off said conveyor means, each controlled by one of said sizing logic circuit means, said sizing logic circuit means including width counter means, said width counter means including means for selecting and monitoring the signal of one of said photosensors and determining if said photosensor is interrupted by a passing object, and a minimum width counter, actuated by said one photosensor signal, and connected to said clock pulse generator means for counting a preset number of said pulses while said one photosensor is interrupted.

11. Apparatus for sorting objects according to size, comprising a plurality of photosensors arrayed in a column, a light source column disposed parallel to and opposite said photosensor column, conveyor means for transporting sid objects between said columns, clock pulse generator means for generating pulses corresponding to a uniform incremental advance of said conveyor means, a plurality of sizing logic circuit means each receiving said clock pulses and the signals from said photosensors, each of said sizing logic circuit means selecting those of said objects which fall within predetermined length and width range criteria, a plurality of impulse devices for removing said selected objects off said conveyor means, each controlled by one of said sizing logic circuit means, and feedback means, connected to all of said sizing logic circuit means, for generating a lockout signal in response to selection of a object by one of said sizing logic circuit means, said lockout signal preventing selection of said object by the other of said sizing logic circuit means.

* * * * *